US008359950B2

(12) United States Patent
Lombardi

(10) Patent No.: US 8,359,950 B2
(45) Date of Patent: Jan. 29, 2013

(54) NAIL SET

(75) Inventor: Keith M. Lombardi, Avon, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 0 days.

(21) Appl. No.: 12/605,629

(22) Filed: Oct. 26, 2009

(65) Prior Publication Data

US 2011/0094353 A1 Apr. 28, 2011

(51) Int. Cl.
*B25C 3/00* (2006.01)

(52) U.S. Cl. ..... 81/44

(58) Field of Classification Search ..... 81/44, 492, 81/438, 439

See application file for complete search history.

(56) References Cited

U.S. PATENT DOCUMENTS

| | | | | |
|---|---|---|---|---|
| 789,520 A | | 5/1905 | Adell et al. | 30/367 |
| 814,020 A | * | 3/1906 | Clifford | 81/439 |
| 1,378,698 A | | 5/1921 | Lindstrom | 81/44 |
| 1,449,136 A | * | 3/1923 | Yates | 30/367 |
| 1,702,607 A | | 2/1929 | Jensen | 81/44 |
| 1,838,462 A | | 12/1931 | Stanford | 81/44 |
| 1,851,112 A | | 3/1932 | Powers | 81/44 |
| 3,034,550 A | | 5/1962 | Dahl | 81/439 |
| 4,096,896 A | * | 6/1978 | Engel | 81/438 |
| 5,123,584 A | * | 6/1992 | Harrison | 81/44 |
| 5,309,798 A | * | 5/1994 | Markwart et al. | 81/438 |
| 6,128,978 A | | 10/2000 | Richey | 81/44 |
| 2005/0172760 A1 | * | 8/2005 | Cantlon | 81/438 |

* cited by examiner

*Primary Examiner* — Hadi Shakeri
(74) *Attorney, Agent, or Firm* — Pillsbury Winthrop Shaw Pittman LLP

(57) ABSTRACT

A nail set includes a body portion and a tool portion. The body portion includes an opening formed therein. The tool portion includes a first work portion at one end portion thereof, and a second work portion at an opposite end portion thereof. The first work portion and the second work portion are constructed and arranged to be interchangeably received in the opening. The tool portion includes an outwardly extending shoulder portion between the first work portion and the second work portion. The outwardly extending shoulder portion is constructed and arranged to provide a path for force transmitted from the body portion, when the tool portion is disposed in the body portion and the body portion is impacted by a tool.

11 Claims, 11 Drawing Sheets

NAIL SET

BACKGROUND OF THE INVENTION

Field of the Invention

The present invention relates to a nail set having a reversible tool portion to facilitate driving of different sized nails.

Nail sets are generally used in woodworking for directing a nail which is protruding above the surface of the work-piece to a depth below the surface of the work-piece to eliminate exposure thereof and for allowing the resulting countersunk hole to be filled with appropriate material (e.g., wood putty) preparatory to finishing the work-piece.

Generally, when the user nails finish nails into the surface of the work-piece, the user often cannot drive the nail completely into the work-piece or the user will damage the surface of the work-piece. The nail set is generally constructed and arranged such that a tip portion of the nail set is placed on a head of the finish nail. A finish nail generally has a dent or groove on its head to allow for placement of the nail set. A setting tool is then configured to impact a head portion of the nail set, driving the finish nail completely into the work-piece. Therefore, the nail set drives the finish nail into the work-piece without damaging the surface of the work-piece.

Nail sets generally have a handle portion which is gripped by a user, a head portion which is impacted by the setting tool, and a tip or work portion which terminates in a point configuration that is adapted securely engage with the nail head while resisting drifting of the tool from head thereby preventing marring or disfiguration of the surrounding material.

Generally in woodworking, finish nails of varying sizes may be utilized. Accordingly, for each discrete nail head, the user must select the appropriate nail set requiring the location and selection thereof for each nail size. A tradesman or user may carry one to three separate nail sets in order to utilize different sized tips. In addition to the need for a separate nail set for each size classification, the associated changeover time may encourage the user to continue to use the current tool for the wrong size nail.

The present invention provides several improvements over the prior art.

SUMMARY OF THE INVENTION

One aspect of the present invention provides a nail set that includes a body portion and a tool portion. The body portion includes an opening formed therein. The tool portion includes a first work portion at one end portion thereof, and a second work portion at an opposite end portion thereof. The first work portion and the second work portion are constructed and arranged to be interchangeably received in the opening. The tool portion includes an outwardly extending shoulder portion between the first work portion and the second work portion. The outwardly extending shoulder portion is constructed and arranged to provide a path for force transmitted from the body portion, when the tool portion is disposed in the body portion and the body portion is impacted by a tool.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated can be considered are drawn to scale. It is to be expressly understood, however, that the drawings are for the purpose of illustration and description only and are not intended as a definition of the limits of the invention. It shall also be appreciated that the features of one embodiment disclosed herein can be used in other embodiments disclosed herein. As used in the specification and in the claims, the singular form of "a", "an", and "the" include plural referents unless the context clearly dictates otherwise.

DETAILED DESCRIPTION OF THE INVENTION

Figure 1A:
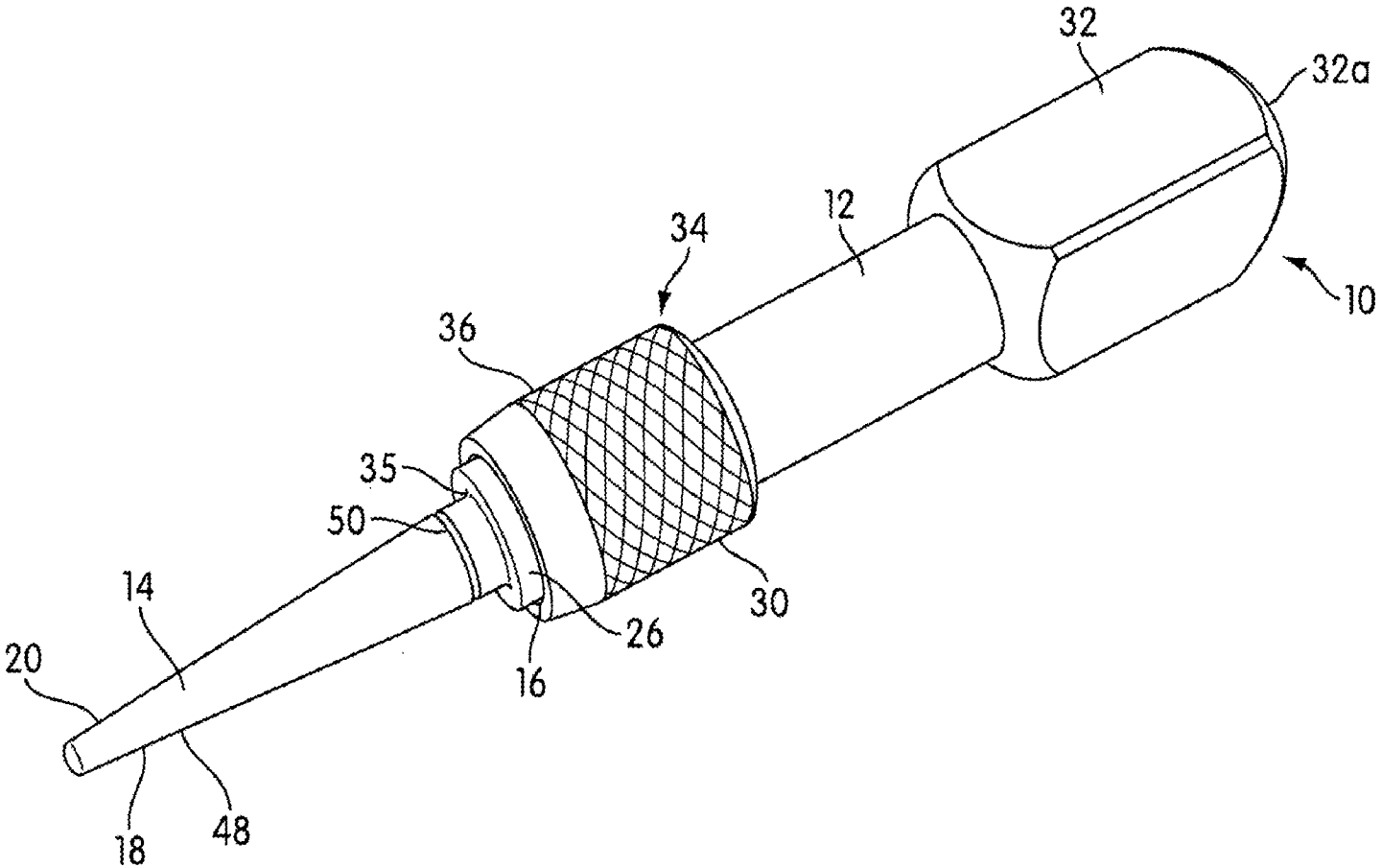
FIG. 1A is a perspective view of a nail set in accordance with an embodiment of the present invention.
Figure 1B:
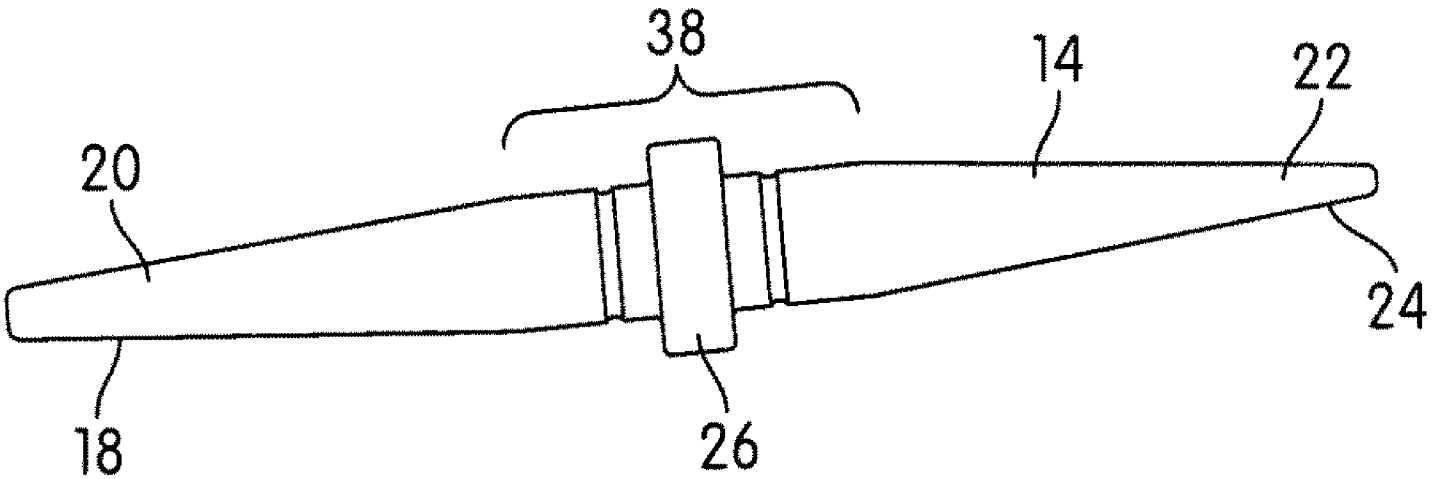
FIG. 1B is a perspective view of a tool portion in accordance with an embodiment of the present invention.
Figure 2:
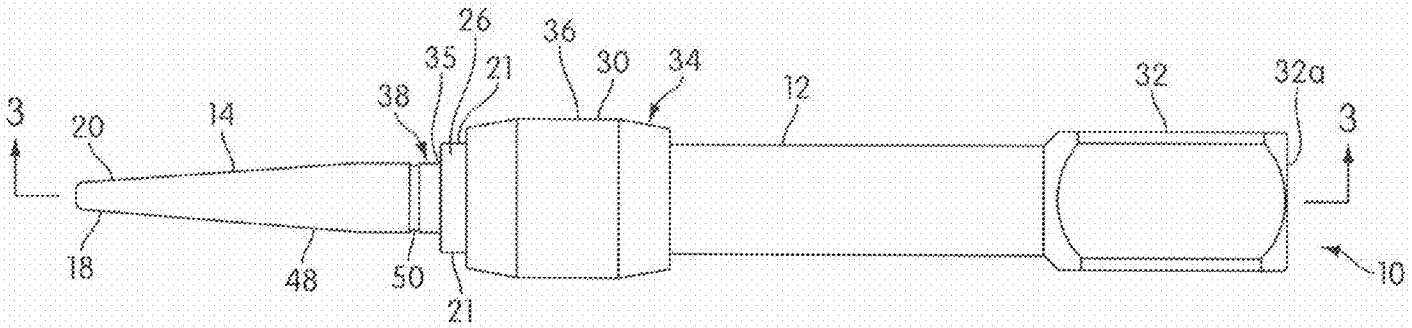
FIG. 2 is a side view of the nail set in accordance with an embodiment of the present invention.
Figure 3:
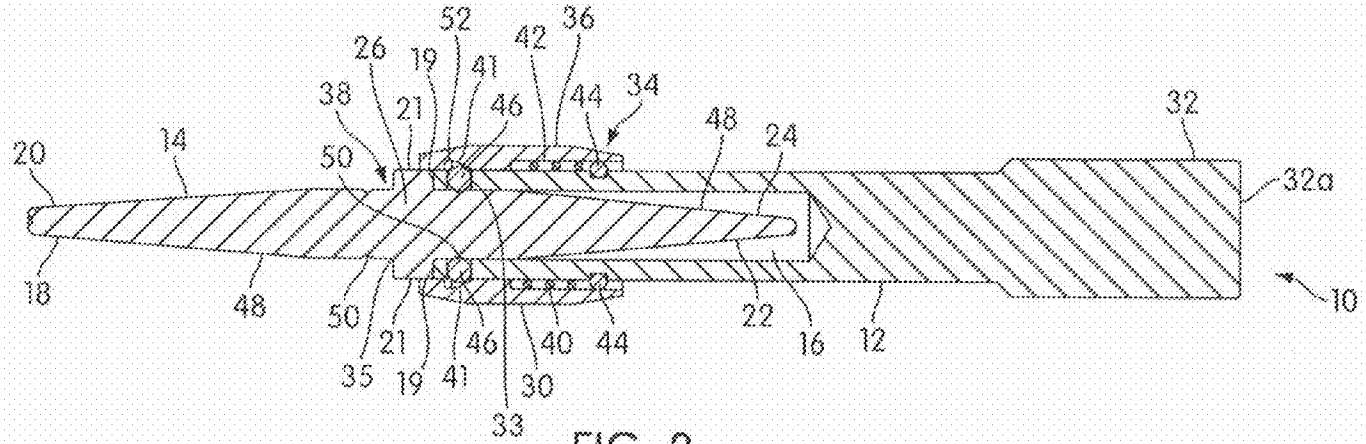
FIG. 3 is a sectional view of the nail set taken along axis 3-3 in FIG. 2 in accordance with an embodiment of the present invention.

FIGS. 1A-4 show a nail set 10 in accordance with an embodiment of the present invention. The nail set 10 includes a body portion 12 and a tool portion 14. The body portion 12 includes an opening 16 formed therein. The tool portion 14 includes a first work portion 18 at one end portion 20 thereof, and a second work portion 22 at an opposite end portion 24 thereof. The first work portion 18 and the second work portion 22 are constructed and arranged to be interchangeably received in the opening 16. The tool portion 14 includes an outwardly extending shoulder portion 26 between the first work portion 18 and the second work portion 22. The outwardly extending shoulder portion 26 is constructed and arranged to provide a path for force transmitted from the body portion 12 to the tool portion 14, when the tool portion 14 is disposed in the body portion 12 and the body portion 12 is impacted by a striking tool, such as a hammer (not shown).

In one embodiment, the body portion 12 and the tool portion 14 are generally made of fully hardened, precision-milled steel or nickel plated steel. The fully hardened, precision-milled steel or the nickel plated steel is generally configured not only to provide the nail set 10 with a longer life but also to reduce bending, cracking, and/or chipping of the nail set 10. In another embodiment, the body portion 12 and the tool portion 14 are generally made of an impact resistant material such as hardened tool steel. In yet another embodiment, the body portion 12 and the tool portion 14 are generally made of alloy steel that is hardened and tempered.

The body portion 12 includes a handle portion 30 and a head portion 32. In one embodiment, the head portion 32 is constructed and arranged to be impacted by a striking tool, such as a hammer. In one embodiment, the head portion 32 may include a head strike surface 32*a* that is constructed and arranged to receive a blow from the impact delivering tool. In the illustrated embodiment, as shown in FIGS. 1A-4, the head portion 32 includes a square-shaped configuration. The square-shaped configuration of the head portion 32 is constructed and arranged to prevent the nail set 10 from rolling when the nail set 10 is set down on a surface. Other shapes of the head portion can be used, such as round or hexagonal, as non-limiting other examples. In one embodiment, the head portion 30 may have advertising or promotional information such as indicia (not shown) for identifying the product and/or manufacturer to the customers.

Figure 4:
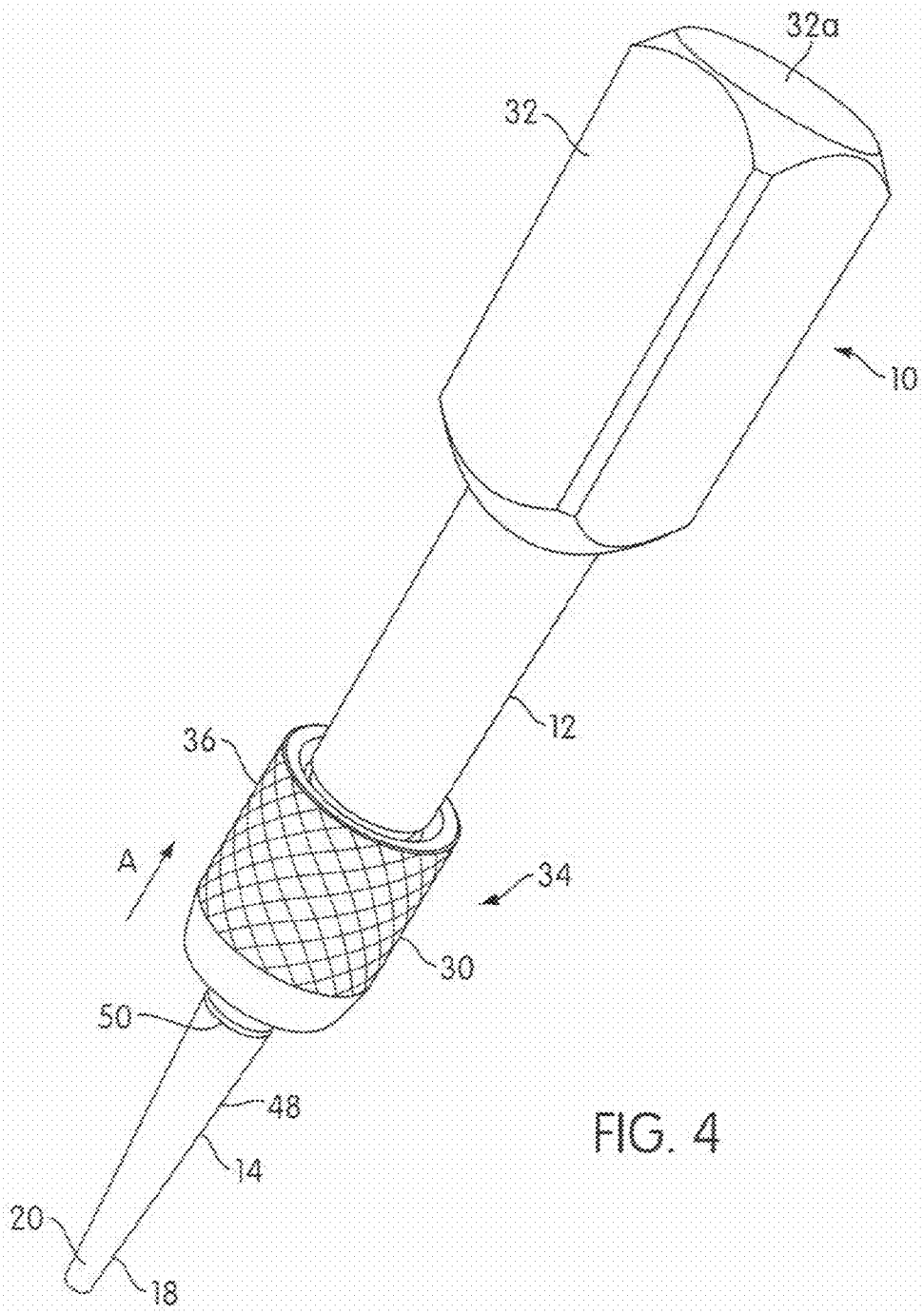
FIG. 4 is a perspective view of the nail set, in which a lock arrangement is pulled up to release the tool portion in accordance with an embodiment of the present invention.

In one embodiment, the handle portion 30 is constructed and arranged to be gripped by the user. The handle portion 30 includes manually engageable gripping portion. In one embodiment, the gripping portion is simply the outer surface of the handle portion 30. In one embodiment, the gripping portion of the handle portion 30 is made of an elastomeric material, a rubber based material, a plastic based material or other suitable material. Optionally, the gripping portion can be ergonomically shaped. In one embodiment, a surface texture or pattern (e.g., ribbed) may be provided on the gripping portion. The surface texture or pattern is constructed and arranged to improve the grip of the user and to improve precision. The ribbed pattern is constructed and arranged to absorb shock of impact from the impact delivering tool. The surface texture or pattern may be provided by knurling, sand blasting, rubber coating, or any other surface texturing methods known in the art. In the illustrated embodiment, as shown in FIGS. 1A and 4, a diamond-shaped (criss-cross) knurling pattern is provided on the handle portion 30 to enable the user's hands or fingers get a better grip on the nail set 10. In one embodiment, the gripping portion may include a slip-resistant surface that is constructed and arranged to be used in all weather conditions. In one embodiment, the gripping portion may include a cushioned grip.

In one embodiment, the length of the body portion 12 is constructed and arranged to enable the user to set nails in hard-to-reach areas. In one embodiment, the body portion 12 may include a knurled surface thereon, where the knurled surface is constructed and arranged to improve the grip of the user.

Figure 9A:
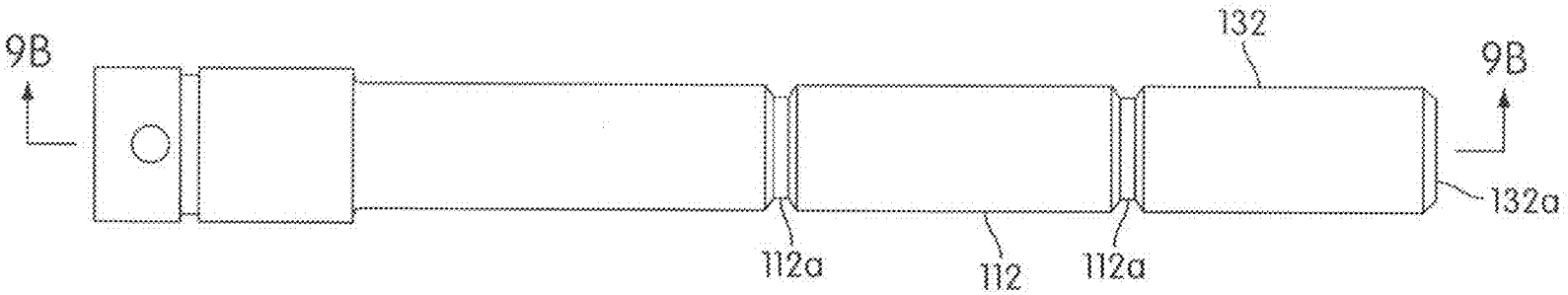
FIGS. 9A-9E show a side view, a sectional view (taken along axis 9B-9B in FIG. 9A), a front view, a rear view and a perspective view of a body portion respectively in accordance with another embodiment of the present invention.
Figure 9B:
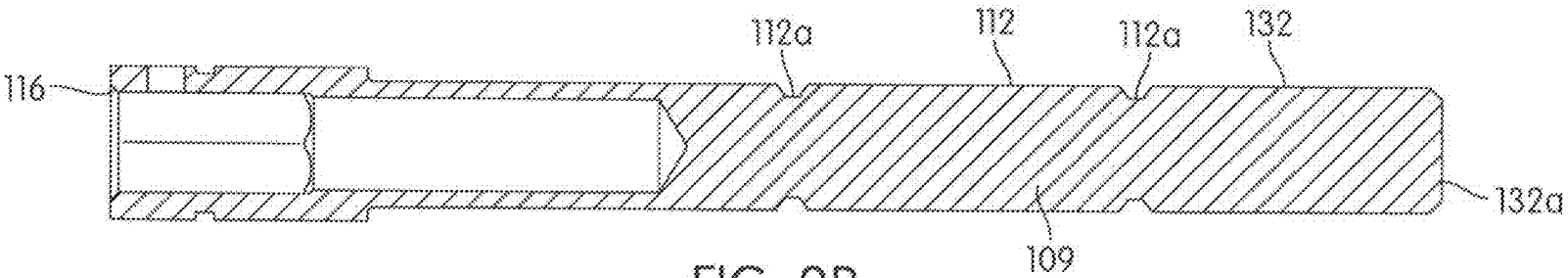
Figure 9C:
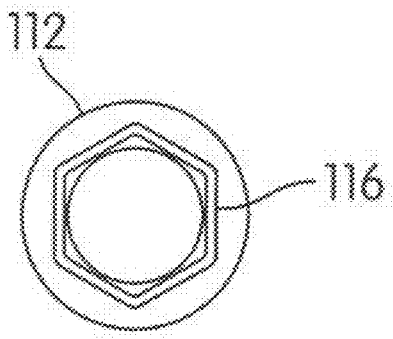
Figure 9D:
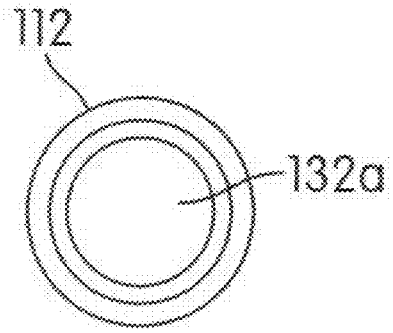
Figure 9E:
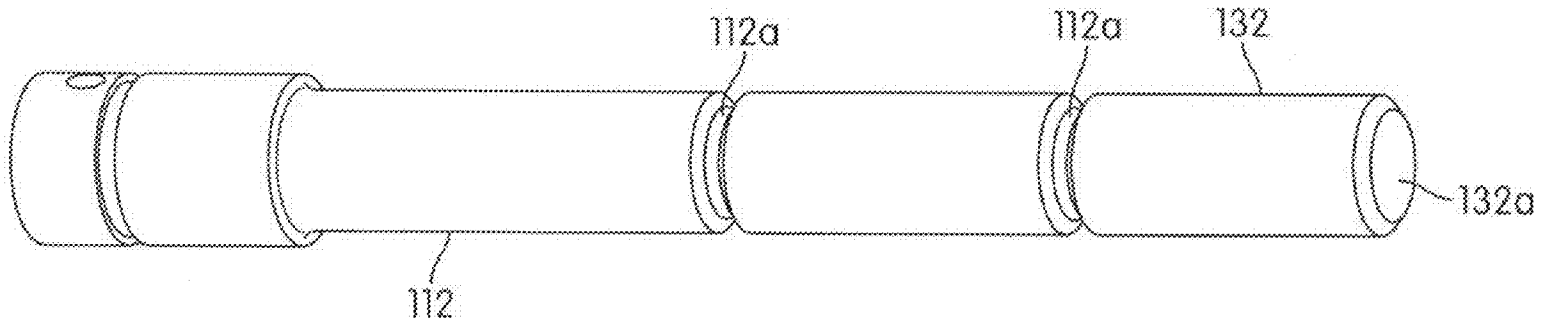

The opening 16 of the body portion 12 is constructed and arranged to receive at least a portion of the tool portion 14. In one embodiment, the opening 16 of the body portion 12 is constructed and arranged to receive one of the first work portion 18 or the second work portion 22 therewithin to lockingly engage the tool portion 14 with the body portion 12. The opening 16 of the body portion 12 generally may include a circular shaped configuration as a non-limiting example. In another embodiment, the opening 16 of the body portion 12 generally may include a hexagonal shaped configuration as will be clear, from discussion with respect to FIGS. 6, 9B and 9C. In one embodiment, a portion of the opening 16 is constructed and arranged to frictionally engage with a portion of the tool portion 14

In one embodiment, the tool portion 14 generally includes a central portion 38, the first work portion 18 and the second work portion 22. In one embodiment, the first work portion 18 and the second work portion 22 may include a conical or frusto-conical shaped configuration that are constructed and arranged to extend away from the central portion 38 of the tool portion 14. The central portion 38 may generally include a circular-shaped or cylindrical-shaped configuration. In another embodiment, at least a portion of the central portion 38 may generally include a hexagonal shaped configuration as will be clear from discussion with respect to FIGS. 8A-8D. As will be discussed below, the shoulder portion 26 is disposed in the central portion 38 of the tool portion 14.

In one embodiment, the first work portion 18 and the second work portion 22 may include a cup-shaped configuration at one end portion 20 and at the opposite end portion 24 respectively. In one embodiment, the first work portion 18 and the second work portion 22 may include a chamfered (or beveled) end or tip at one end portion 20 and at the opposite end portion 24 respectively. In another embodiment, different shaped and/or sized tips are provided at the opposite end portions 20 and 24.

The tool portion 14 of the nail set 10 is removable from the body portion 12 of the nail set 10. Since the tool portion 14 of the nail set 10 is removable from the body portion 12, the nail set 10 may receive other types of tips for performing different functions (i.e., tips that are not nail set tips), for example, a punch or hole-starting tips. In one embodiment, the tool portion 14 may include a punch. In one embodiment, one of the tips is a screwdriver tip.

The tool portion 14 of the nail set 10 is reversible within the body portion 12 of the nail set 10 in one embodiment to facilitate countersinking of different sized nails. In other words, the reversible configuration of the tool portion 14 enables a user to select and use either the first work portion 18 or the second work portion 22 of the tool portion 14. The first work portion 18 includes a different sized tip configuration than the second work portion 22.

When one of the first work portion 18 or the second work portion 22 is received in the opening 16 of the body portion 12 (i.e., to lockingly engage the tool portion 14 with the body portion 12), the other of the first work portion 18 or the second work portion 22 is exposed (i.e., outside the body portion 12) for operation. Therefore, the nail set 10 includes two operating configurations, where each operating configuration provides a nail set with a different sized tip. In the first operating configuration, the first work portion 18 is exposed (i.e., outside the body portion 12) for operation and the second work portion 22 is disposed inside the body portion 12 to lockingly engage the tool portion 14 with the body portion 12. In the second operating configuration, the second work portion 22 is exposed (i.e., outside the body portion 12) for operation and the first work portion 18 is disposed inside the body portion 12 to lockingly engage the tool portion 14 with the body portion 12.

In one embodiment, the first work portion 18 and the second work portion 22 are constructed and arranged to be related with nail heads of different sizes. In one embodiment, the first work portion 18 and the second work portion 22 of the tool portion 14 may be color coded by their tip size for quick identification. The color coding may be provided by one or more color bands or stripes that are circumferentially placed on the first work portion 18 and the second work portion 22. For example, for 1/32" tip a yellow color band is provided on the work portion, for a 2/32" tip size a grey color band is provided on the work portion, and for a 3/32" tip size a red color band is provided on the work portion. Other identification mechanisms, such as any combination of letters, numerals, and symbols may also be used for labeling the tip size of the work portions. These identification mechanisms are configured to facilitate selective identification (i.e., by size of their tip) of similar sized work portions 18 and 22. Also, these identification mechanisms are configured to permit a user or a tradesman to quickly select the work portion 18 or 22 of the desired size without viewing the size of their tip.

In one embodiment, the body portion 12 and the tool portion 14 may include a circular-shaped or a round-shaped cross-sectional configuration. This circular-shaped or round-shaped cross-sectional configuration enables the nail set 10 to transmit only linear force and to prevent transmitting any torsional force.

The shoulder portion 26 is constructed and arranged to extend outwardly from the central portion 38 of the tool portion 14. In one embodiment, the shoulder portion 26 is circumferentially disposed on an external surface 35 in the central portion 38 of the tool portion 14. In one embodiment, the shoulder portion 26 is disposed at the center of the overall length of the tool portion 14. In one embodiment, the shoulder portion 26 disposed on the central portion 38 generally include a circular-shaped configuration.

The enlarged shoulder portion 26 is constructed and arranged to provide a direct path for a force transmitted from the body portion 12. In other words, when the tool portion 14 is disposed in the body portion 12 and the body portion 12 is impacted by the tool, the force delivered by the tool (e.g., hammer) to the body portion 12 is transmitted to the tool portion 14 via the shoulder portion 26. The shoulder portion 26 includes a first surface portion 19 and a second surface portion 21, wherein the first surface portion 19 is generally perpendicular to the second surface portion 21. In one embodiment, the first surface portion 19 is an annular surface constructed and arranged to engage with a portion of the body portion 12, for example a forwardmost circular surface defining the mouth of the opening 16. The contact areas that are formed by the engagement of the first surface portion 19 of the shoulder portion 26 with at least the portion of the body portion 12 are constructed and arranged to transmit the force from the body portion 12 to the tool portion 14.

In one embodiment, the nail set 10 includes a lock arrangement 34. The lock arrangement 34 includes a movable member 36 (e.g., in the form of an outer sleeve) that is movable between a locking position and an unlocking position. In one embodiment, the movable member 36 is constructed and arranged to move in a linear motion (i.e., up and down, or back and forth). The movement of the movable member 36 from the locking position to the unlocking position unlocks the tool portion 14 to enable the tool portion 14 to be removed from the body portion 12. The lock arrangement 34 is spring biased into the locked position to prevent the removal of the tool portion 14 from the body portion 12.

The lock arrangement 34 includes a spring 40. In one embodiment, the spring 40 may include a coil spring or a compression spring. In one embodiment, the spring 40 is disposed between the body portion 12 and the movable member 36. In one embodiment, the movable member 36 may include a recess 42 that is constructed and arranged to receive the spring 40 therewithin. The spring 40 is constructed and arranged to engage with at least a portion of the movable member 36 at one end and with a split ring 44 at the other end. The split ring 44 is secured to the body portion 12. The split ring 44 is constructed and arranged to retain the spring 40, when the spring 40 is compressed by the movable member 36.

The lock arrangement 34 includes one or more ball bearings 46 that are disposed in an opening 33 in the body portion 12 of the nail set 10. In one embodiment, one or more ball bearings 46 are disposed at circumferentially spaced locations around the tool portion 14. The ball bearings 46 are constructed and arranged to frictionally engage with a surface 48 of the first work portion 18 or the second work portion 22. Specifically, in one embodiment, grooves or notches 50 may be disposed on the surface 48 of the first work portion 18 or the second work portion 22 to engage with the ball bearings 46. In another embodiment, the grooves or notches 50 may be disposed on the surface of the central portion 38 of the tool portion 14. Such grooves or notches 50 are located on both sides of the shoulder portion 26. The grooves or notches 50 are constructed and arranged to lockingly receive the ball bearings 46 therein, when the lock arrangement 34 is in the locking position. In one embodiment, the groove or notch 50 is an annular groove constructed and arranged to extend circumferentially around the tool portion 14.

The movable member 36 includes, groove(s) or notch(es) 52 that are constructed and arranged to receive the ball bearing(s) 46 therewithin, when the lock arrangement 34 is in the unlocking position. The groove(s) or notch(es) 52 transition into a ramp surface 41 as the inner surface of the movable member 36 extends rearwardly from the groove(s) or notch (es) 52. The spring bias of the spring(s) 40 pushes the movable member 36 forwardly, forcing the ball bearings 46 up the ramp surface 41, which thus forces the ball bearings 46 inwardly against the surface of the tool portion 14.

Thus, when the lock arrangement 34 is in the locking position, the movable member 36 is constructed and arranged to apply a force to the ball bearings 46. Such force applied to the ball bearings 46 enables the ball bearings 46 to protrude into an inner diameter of the body portion 12 and to lockingly engage with the grooves or notches 50 that are disposed on the surface 48 of the first work portion 18 or the second work portion 22. Therefore, the ball bearings 46 are frictionally engaged with the grooves or notches 50 (i.e., on one of the first work portion 18 or the second work portion 22, which is disposed in the opening 16 of the body portion 12) to lock the tool portion 14 within the body portion 12 and to prevent the tool portion 14 from falling out of the body portion 12 of the nail set 10. Also, when the lock arrangement 34 is in the locking position, the spring 40 is in its relaxed configuration.

In order to release the tool portion 14 from the body portion 12, the movable member 36 is moved rearwards from the locking position to the unlocking position (i.e., in the direction of an arrow A as shown in FIG. 4). When the movable member 36 is moved from the locking position to the unlocking position, the movable member 36 is constructed and arranged to compress the spring 40. In other words, the portion of the movable member 36, which engages with the spring 40 at one end thereof, is constructed and arranged to compress the spring 40 from its relaxed configuration to a compressed (or tensioned) configuration. Also, when the movable member 36 is moved from the locking position to the unlocking position (i.e., against the action of spring 40 and in the direction of the arrow A as shown in FIG. 4), the ball bearings 46 move down the ramp surface 41 and into the groove(s) or notch(es) 52 in the inner surface of the movable member 36. Thus, the ball bearings 46 area able to move outwardly for disengagement from the grooves or notches 50 on the surface 48 of the first work portion 18 or the second work portion 22. This outwardly movement of the ball bearings 46 unlocks the tool portion 14 from the body portion 12, and permits the removal of the tool portion 14 from the body portion 12. The ball bearings 46 that are disengaged from the grooves or notches 50 on the surface 48 of the tool portion 14 are constructed and arranged to move into the groove(s) or notch(es) 52 of the movable member 36. Therefore, when the lock arrangement 34 is in the unlocking position, the ball bearings 46 are constructed and arranged to engage with the groove(s) or notch(es) 52 of the movable member 36.

The tool portion 14 that is removed from the body portion 12 may then be reversed (e.g., by 180 degrees) and inserted back into the body portion 14 to expose (i.e., outside the body portion 12) the other of the first work portion 18 or the second work portion 22 for operation. Once the tool portion 14 is inserted into the body portion, the movable member 36 is released back to its lock position. The spring 40 is constructed and arranged to bias the movable member 36 (i.e., with respect to the body portion 12) from unlocking position to the locking position so that the ball bearings 46 that are engaged with the grooves or notches 52 of the movable member 36 are moved up the ramp surface 41 and brought into engagement with the grooves or notches 50 of the first work portion 18 or the second work portion 22, when the tool portion 14 is inserted back into the body portion 12.

Figure 5:
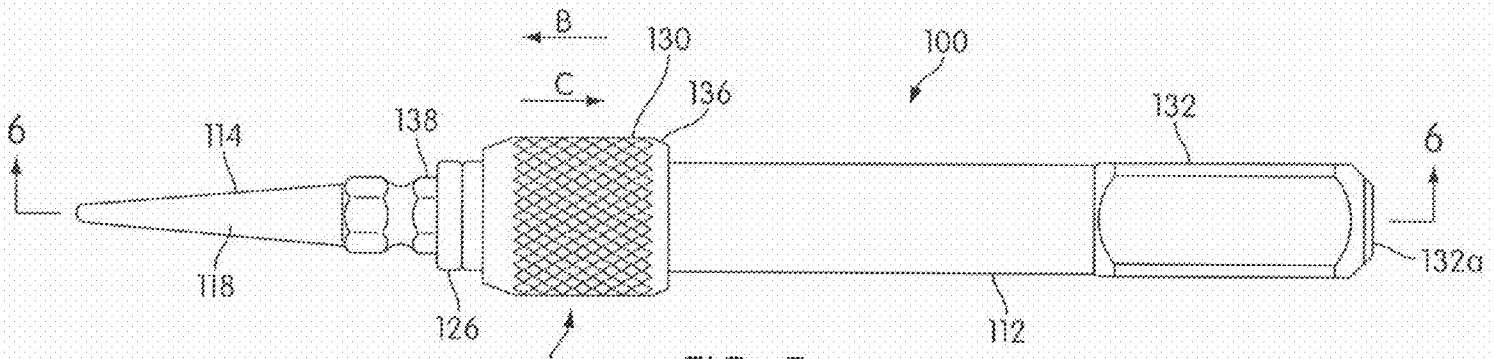
FIG. 5 is a side view of the nail set in accordance with another embodiment of the present invention.
Figure 6:
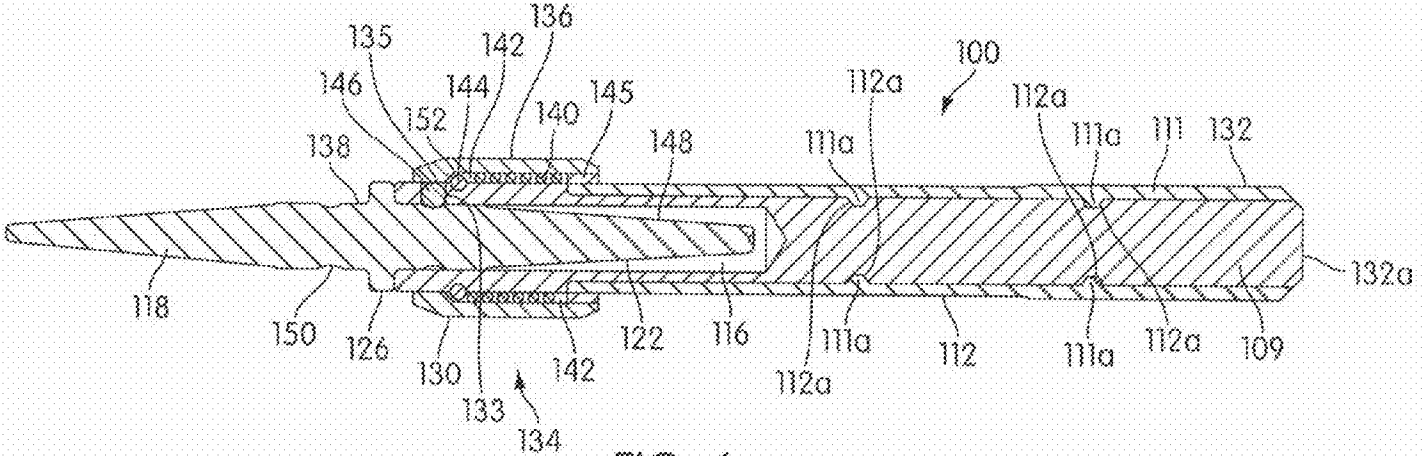
FIG. 6 is a sectional view of the nail set taken along axis 6-6 in FIG. 5 in accordance with another embodiment of the present invention.
Figure 7:
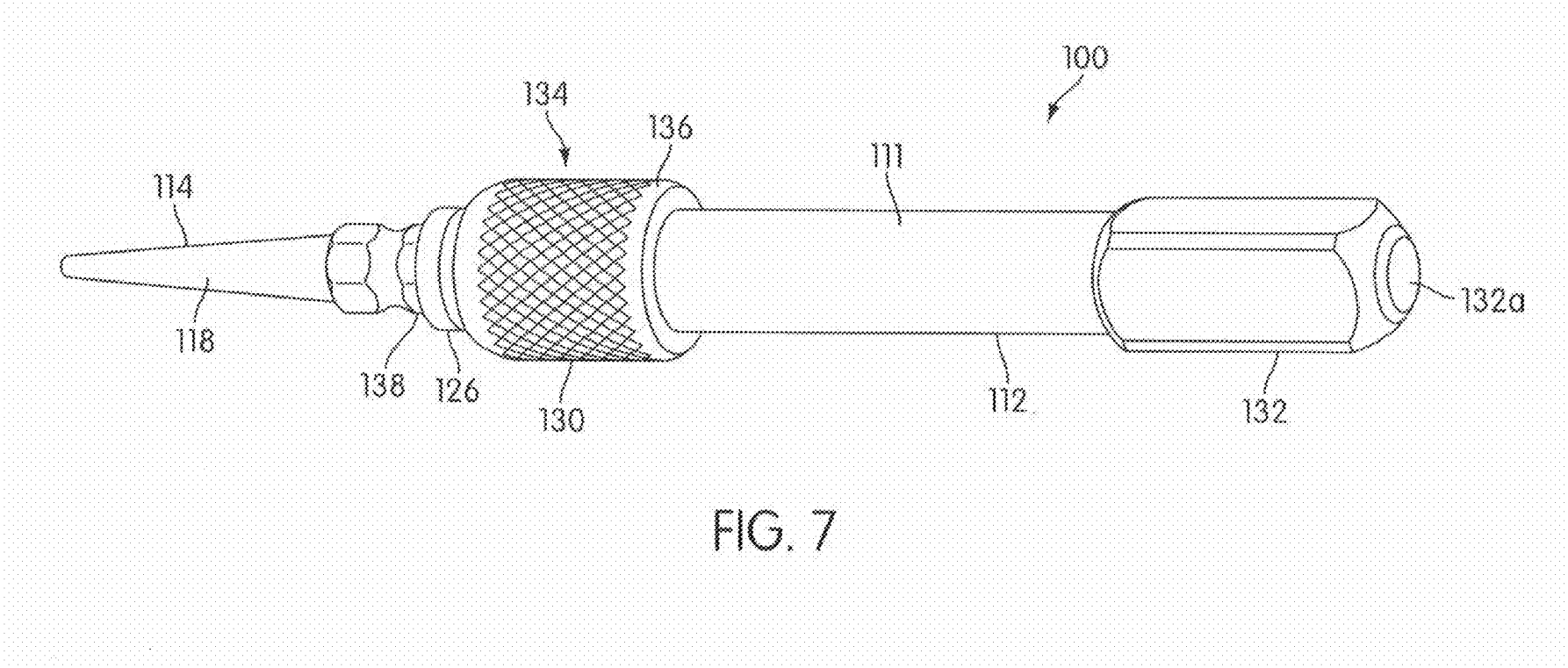
FIG. 7 is a perspective view of the nail set, in which a lock arrangement is pushed to release the tool portion in accordance with another embodiment of the present invention.
Figure 8A:
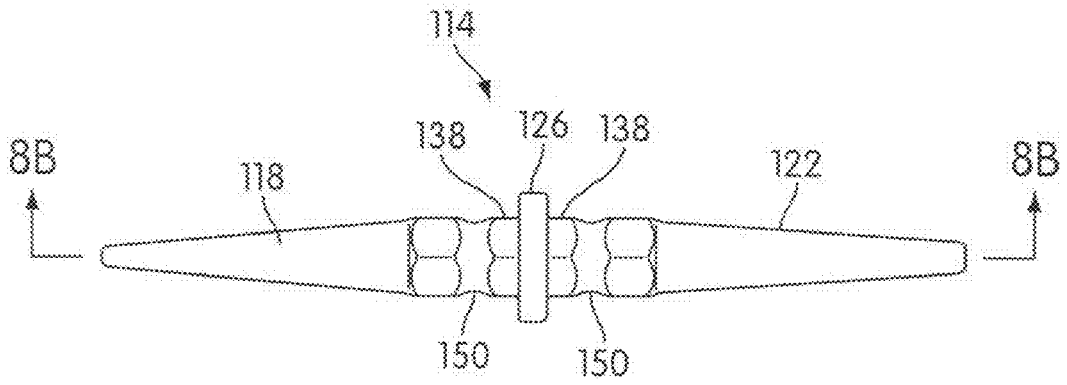
FIGS. 8A-8D show a side view, a sectional view (taken along axis 8B-8B in FIG. 8A), a front view, and a perspective view of a tool portion respectively in accordance with another embodiment of the present invention.
Figure 8B:
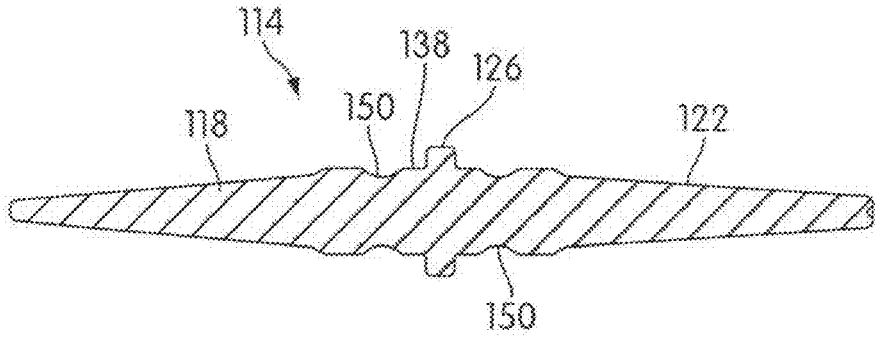
Figure 8C:
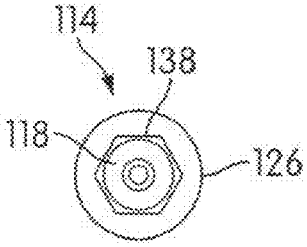
Figure 8D:
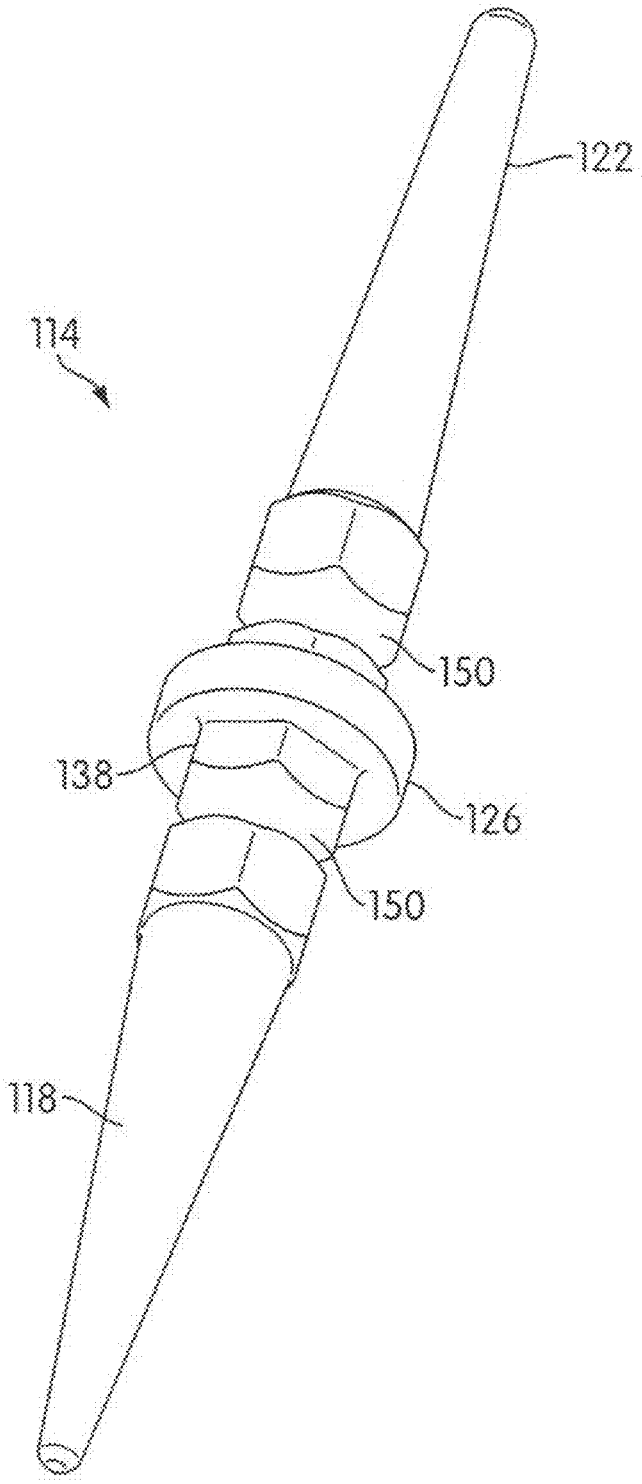

FIGS. 5-7 show another embodiment of the present invention, in which a nail set 100 is shown. The nail set 100 includes a body portion 112 and a tool portion 114.

As shown in FIGS. 5-7 and FIGS. 9A-9E, the body portion 112 includes a handle portion 130 and a head portion 132. In one embodiment, the head portion 132 may include a head strike surface 132*a* that is constructed and arranged to be impacted by (i.e., to receive, a blow from) an impact delivering tool or a striking tool, such as a hammer. The handle portion 130 is constructed and arranged to be gripped by the user and may include a manually engageable gripping portion as described in the previous embodiment.

As shown in FIG. 6, the body portion 112 of the nail set 100 may include a core portion 109, and an over mold portion 111. In one embodiment, the over mold portion 111 is made of an elastomeric material, a rubber based material, a plastic based material or other suitable material. In one embodiment, the over mold portion 111 may include first engaging portions 111*a* that are constructed and arranged to engage with second engaging portions 112*a* of the core portion 109 to attach the over mold portion 111 with the core portion 109.

In one embodiment, the first engaging portions 111*a* may include projections or protruding members extending from the over mold portion 111. In such embodiment, the second engaging portions 112*a* of the core portion 109 may include grooves or openings that are constructed and arranged to receive the first engaging portions 111*a*. Alternatively, in another embodiment, the first engaging members 111*a* may include grooves or openings and the second engaging members 112*a* may include protrusions or protruding members. It should be appreciated, however, that this embodiment is but one example of different types of engagement member shapes, configurations and/or constructions that can be provided. In one embodiment, as shown in FIG. 6, the over mold portion 111 is attached to the core portion 109 before the handle portion 130 is attached to the body portion 112.

An opening 116 of the body portion 112 is constructed and arranged to receive at least a portion of the tool portion 114. In one embodiment, the opening 116 of the body portion 112 is constructed and arranged to receive one of the first work portion 118 or the second work portion 122 therewithin to lockingly engage the tool portion 114 with the body portion 112. The opening 116 of the body portion 112 generally may include a hexagonal shaped configuration. In one embodiment, a portion of the opening 116 is constructed and arranged to frictionally engage with a portion of the tool portion 114.

The hexagonal shaped configuration of the opening 116 is constructed and arranged to minimize or prevent the rotation of the tool portion 114, when the tool portion 114 is received in the body portion 112 (i.e., during use).

The hexagonal shaped configuration of the opening 116 is constructed and arranged to enhance the engagement between the body portion 112 and tool portion 114. Enhanced engagement between the body portion 112 and tool portion 114 reduces any irregular rocking or staggering side to side motion of the tool portion 114, when the tool portion 114 is received in the body portion 112.

The hexagonal shaped configuration of the opening 116 is constructed and arranged to allow the user to install standard hexagonal shaped screwdriver bits so as to use the nail set 100 as a screwdriver when a need arises.

In one embodiment, the tool portion 114 generally includes the central portion 138, the first work portion 118 and the second work portion 122. The central portion 138 may generally include a hexagonal shaped configuration that is constructed and arranged to engage with the hexagonal shaped opening 116 of the body portion 112. As will be discussed below, a shoulder portion 126 is disposed in the central portion 138 of the tool portion 114.

In one embodiment, the nail set 100 includes a lock arrangement 134. The lock arrangement 134 includes a movable member 136 (e.g., in the form of an outer sleeve) that is movable between a locking position and an unlocking position. In one embodiment, the movable member 136 is constructed and arranged to move in a linear motion (i.e., up and down, or back and forth). The movement of the movable member 136 from the locking position to the unlocking position unlocks the tool portion 114 to enable the tool portion 114 to be removed from the body portion 112. The lock arrangement 134 is spring biased into the locked position to prevent the removal of the tool portion 114 from the body portion 112.

The lock arrangement 134 includes a spring 140. In one embodiment, the spring 140 may include a coil spring or a compression spring. In one embodiment, the spring 140 is disposed between the body portion 112 and the movable member 136. In one embodiment, the movable member 136 may include a recess 142 that is constructed and arranged to receive the spring 140 therewithin. The spring 140 is constructed and arranged to engage with a locking ring 145 at one end and with a split ring 144 at the other end. The split ring 144 is secured to the body portion 12. The split ring 144 is constructed and arranged, to retain the spring 140, when the spring 140 is compressed by the locking ring 145. In one embodiment, the locking ring 145 is constructed and arranged to be connected to and movable with the movable member 136.

The lock arrangement 134 includes one or more ball bearings 146 that are disposed in an opening 133 in the body portion 112 of the nail set 100. In one embodiment, one or more ball bearings 146 are disposed at circumferentially spaced locations around the tool portion 114. The ball bearings 146 are constructed and arranged to frictionally engage with a surface 148 of the first work portion 118 or the second work portion 122. Specifically, in one embodiment, grooves or notches 150 may be disposed on the surface 148 of the first work portion 118 or the second work portion 122 to engage with the ball bearings 146. In another embodiment, the grooves or notches 150 may be disposed on the surface of the central portion 138 of the tool portion 114. Such grooves or notches 150 are located on both sides of the shoulder portion 126. The grooves or notches 150 are constructed and arranged to lockingly receive the ball bearings 146 therein, when the lock arrangement 134 is in the locking position. In one embodiment, the groove or notch 150 is an annular groove constructed and arranged to extend circumferentially around the tool portion 114.

The recess 142 of the movable member 136 is constructed and arranged to receive the ball bearing(s) 146 therewithin, when the lock arrangement 134 is in the unlocking position. The spring bias of the spring(s) 140 pushes the locking ring 145 rearwardly (in the direction of an arrow C in the FIG. 5), forcing the ball bearings 146 to move out of engagement with the recess 142 and into engagement the surface of the tool portion 114.

Thus, when the lock arrangement 134 is in the locking position, a surface portion 135 of the movable member 136 is constructed and arranged to apply a force to the ball bearings 146. Such force applied to the ball bearings 146 enables the ball bearings 146 to protrude into an inner diameter of the body portion 112 and to lockingly engage with the grooves or notches 150 that are disposed on the surface 148 of the first work portion 118 or the second work portion 122. Therefore, the ball bearings 146 are frictionally engaged with the grooves or notches 150 (i.e., on one of the first work portion 118 or the second work portion 122, which is disposed in the opening 116 of the body portion 112) to lock the tool portion 114 within the body portion 112 and to prevent the tool portion 114 from falling out of the body portion 112 of the nail set 100. Also, when the lock arrangement 134 is in the locking position, the spring 140 is in its relaxed configuration.

In order to release the tool portion 114 from the body portion 112, the movable member 136 is moved forwardly from the locking position to the unlocking position (i.e., in the direction of an arrow B as shown in FIG. 5). When the movable member 136 is moved from the locking position to the unlocking position, the locking ring 145 is constructed and arranged to compress the spring 140. In other words, the portion of the locking ring 145, which engages with the spring 140 at one end thereof, is constructed and arranged to compress the spring 140 (i.e., against the split ring 144, which remains stationary) from its relaxed configuration to a compressed (or tensioned) configuration. Also, when the movable member 136 is moved from the locking position to the unlocking position (i.e., against the action of spring 140 and in the direction of the arrow B as shown in FIG. 5), the ball bearings 146 are received in the recess 142 of the movable member 136. Thus, the ball bearings 146 are able to move outwardly for disengagement from the grooves or notches 150 on the surface 148 of the first work portion 118 or the second work portion 122. This outwardly movement of the ball bearings 146 unlocks the tool portion 114 from the body portion 112, and permits the removal of the tool portion 114 from the body portion 112. The ball bearings 146 that are disengaged from the grooves or notches 150 on the surface 148 of the tool portion 114 are constructed and arranged to move into engagement with the recess 142 of the movable member 136. Therefore, when the lock arrangement 134 is in the unlocking position, the ball bearings 146 are constructed and arranged to be received within the recess 142 of the movable member 136.

The tool portion 114 that is removed from the body portion 112 may then be reversed (e.g., by 180 degrees) and inserted back into the body portion 114 to expose (i.e., outside the body portion 112) the other of the first work portion 118 or the second work portion 122 for operation. Once the tool portion 114 is inserted into the body portion 112, the movable member 136 is released back to its lock position. The spring 140 is constructed and arranged to bias the locking ring 145 attached (or connected) to the movable member 136 (i.e., with respect to the body portion 112) from unlocking position to the locking position so that the ball bearings 146 that are received within the recess 142 of the movable member 136 are brought into engagement with the grooves or notches 150 of the first work portion 118 or the second work portion 122, when the tool portion 114 is inserted back into the body portion 112.

Although the invention has been described in detail for the purpose of illustration, it is to be understood that such detail is solely for that purpose and that the invention is not limited to the disclosed embodiments, but, on the contrary, is intended to cover modifications and equivalent arrangements that are within the spirit and scope of the appended claims. In addition, it is to be understood that the present invention contemplates that, to the extent possible, one or more features of any embodiment can be combined with one or more features of any other embodiment.

What is claimed is:

1. A nail set comprising:

a body portion comprising an opening formed therein; and a tool portion comprising a first work portion at one end portion thereof and a second work portion at an opposite end portion thereof, the first work portion and the second work portion constructed and arranged to be interchangeably received in the opening, the tool portion comprising an outwardly extending shoulder portion between the first work portion and the second work portion and a body portion engaging surface for engaging with a tool portion engaging surface of the body portion; and a releasable lock arrangement to lock the tool portion and the body portion, wherein the body portion engaging surface and the tool portion engaging surface engage one another and each include a circular shaped cross-sectional configuration, wherein the outwardly extending shoulder portion is constructed and arranged to provide a path for force transmitted from the body portion, when the tool portion is disposed in the body portion and the body portion is impacted by a tool, wherein the body portion is a one-piece integral structure so that the force is transmitted directly from the body portion to the tool portion, wherein the direct force transmission path is configured to transmit the force from the body portion to the tool portion without transmitting the entire force through the lock arrangement, and wherein the lock arrangement includes a movable member that is movable between a locking position and an unlocking position, wherein linear movement of the movable member from the locking position to the unlocking position unlocks the tool portion to enable the tool portion to be removed from the body portion.

2. The nail set of claim 1, wherein the body portion comprising a handle portion constructed and arranged to be gripped by a user.

3. The nail set of claim 1, wherein the body portion comprising a head portion constructed and arranged to be impacted by the tool.

4. The nail set of claim 1, wherein the tool portion is a punch.

5. The nail set of claim 1, wherein the first work portion having a different sized configuration than the second work portion.

6. The nail set of claim 1, wherein the tool portion is reversible to enable a user to use either the first work portion or the second work portion.

7. The nail set of claim 1, wherein the lock arrangement is spring biased into the locked position to prevent the tool portion to be removed from the body portion.

8. The nail set of claim 1, wherein the shoulder portion is circumferentially disposed on an external surface in a central portion of the tool portion.

9. The nail set of claim 1, wherein the releasable lock arrangement further comprises at least one ball bearing arranged in at least one opening of the body portion, and wherein the at least one ball bearing disposed in the at least one opening is constructed and arranged to frictionally engage with a surface of the tool portion.

10. The nail set of claim 9, wherein the surface of the tool portion includes recess constructed and arranged to lockingly receive the at least one ball bearing therein.

11. A nail set comprising:

a body portion comprising an opening formed therein; and a tool portion comprising a first work portion at one end portion thereof and a second work portion at an opposite end portion thereof, the first work portion and the second work portion constructed and arranged to be interchangeably received in the opening, the tool portion comprising an outwardly extending shoulder portion between the first work portion and the second work portion and a body portion engaging surface for engaging with a tool portion engaging surface of the body portion; and a releasable lock arrangement to lock the tool portion and the body portion, wherein the body portion engaging surface and the tool portion engaging surface engage one another and each include a circular shaped cross-sectional configuration, wherein the outwardly extending shoulder portion is constructed and arranged to provide a path for force transmitted from the body portion, when the tool portion is disposed in the body portion and the body portion is impacted by a tool, wherein the body portion is a one-piece integral structure so that the force is transmitted directly from the body portion to the tool portion, wherein the direct force transmission path is configured to transmit the force from the body portion to the tool portion without transmitting the entire force through the lock arrangement, wherein the releasable lock arrangement further comprises at least one ball bearing arranged in at least one opening of the body portion, wherein the at least one ball bearing disposed in the at least one opening is constructed and arranged to frictionally engage with a surface of the tool portion, wherein the surface of the tool portion includes recess constructed and arranged to lockingly receive the at least one ball bearing therein, and wherein the releasable lock arrangement further comprises a movable member constructed and arranged to apply a force to the at least one ball bearing so as to retain the at least one ball bearing in locking engagement with the recess disposed on the surface of the tool portion.

* * * * *